United States Patent [19]

Thomas et al.

[11] Patent Number: 4,502,496

[45] Date of Patent: Mar. 5, 1985

[54] HAIR CURLING DEVICE

[76] Inventors: Cornelia Thomas; Rachel T. Wingert, both of 3 Halkin Mews, Belgrave Sq., London, England, SW1X 8JZ

[21] Appl. No.: 332,657

[22] Filed: Dec. 21, 1981

[30] Foreign Application Priority Data

Dec. 30, 1980 [GB] United Kingdom ..... 8041445

[51] Int. Cl.[3] ..... A45D 2/00

[52] U.S. Cl. ..... 132/40; 132/33 R

[58] Field of Search ..... 132/33 R, 40, 39, 34 R

[56] References Cited

U.S. PATENT DOCUMENTS

| | | | |
|---|---|---|---|
| 2,910,989 | 11/1959 | Russell | 132/40 |
| 3,376,875 | 4/1968 | Rosan | 132/40 |
| 3,478,755 | 11/1969 | Jorgensen | 132/33 R |
| 3,693,636 | 9/1972 | Tomiati | 132/33 R |
| 4,202,360 | 5/1980 | Henry | 132/40 |

*Primary Examiner*—Gregory E. McNeill

*Attorney, Agent, or Firm*—McAulay, Fields, Fisher, Goldstein & Nissen

[57] ABSTRACT

A hair setting or curling device has a central core of a material capable of retaining heat. The core comprises a tubular body with flanges at each end. The core is fitted inside an outer cage which is coaxial with the core. The cage includes a plurality of strips which extend longitudinally of the cage and are spaced from each other around the cage. The strips are also spaced from the central body of the core so that air can circulate between the cage and the strips and through the spaces between adjacent strips. Hair to be curled is wrapped around the outer cage and the strips are provided with bristle-like projections to assist in retaining the hair in the wrapped condition around the cage.

6 Claims, 4 Drawing Figures

HAIR CURLING DEVICE

BACKGROUND OF THE INVENTION

Hair setting rollers which are heated before being inserted in the hair are known. Such rollers are normally of cylindrical or bobbin shape. Locks of hair are wound round the roller and held there by a suitable clip which holds the hair in the wound position on the roller. The roller remains in position in the hair long enough for curls of some permanence to be formed.

It is commonplace to heat the rollers by placing them over an electrically heated mounting post. The roller contains a suitable heat retaining substance. A temperature of 50° C. to 120° C. is normally maintained after the roller has been removed from the heating post.

The heat and tension in the wound hair tends to form curls. Unfortunately, excesses of either heat or tension may make the hair brittle or dry or lacking in body or to become electrically charged and so subsequently to "fly away". Known such rollers are often difficult to clip reliably in particular where the hair of the person using the device is short. One such roller is described in U.K. Patent Specification No. 1355510. Others are described in U.S. Pat. Nos. 3,410,985, 3,257,541 and Re. 26,766.

An object of the present invention is to provide an improved hair setting roller or curler of the kind described with which the risk of damage of the hair while the roller is inserted therein is reduced and with which the clipping in of a roller is easier than heretofore.

Another object is to provide a hair setting roller which results in curls having a softer wavy effect for example as is typical in blow dried hair. The invention is not concerned with the heating of the roller.

BRIEF SUMMARY OF THE INVENTION

The present invention provides a hair setting roller comprising a heatable central core of a material capable of retaining heat applied thereto and an outer cage which surrounds and is coaxial with the central core, the said cage including a plurality of strips which extend longitudinally of the cage, are spaced from each other around the cage, and are also spaced from the central core whereby air can circulate between the cage and the strips and through the spaces between adjacent strips. The said strips may be provided with external projections to assist in retaining hair wrapped around the cage. If desired the central core may be removable from the outer cage. In another modification a second cage removably surrounds and is spaced from the outer cage.

The cage or cages is/are preferably made of plastics material and are of light weight. When hair is wound round the outer cage a cylinder is to some extent formed by the hair itself and a jacket is provided between the heated core and the inside of the cage.

BRIEF DESCRIPTION OF THE ACCOMPANYING DRAWINGS

Figure 1:
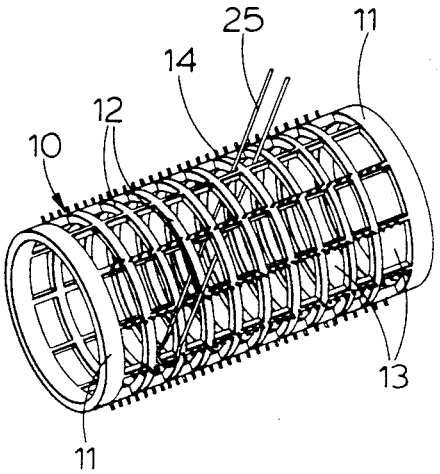
Figure 1:
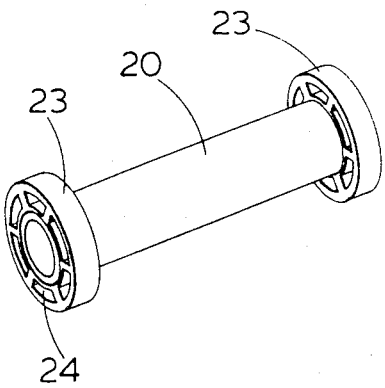
Figure 2:
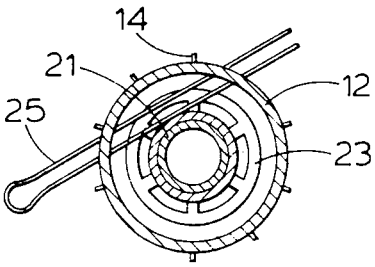
Figure 3:
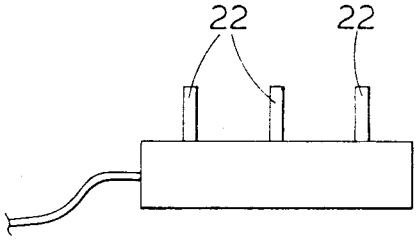
Figure 4:
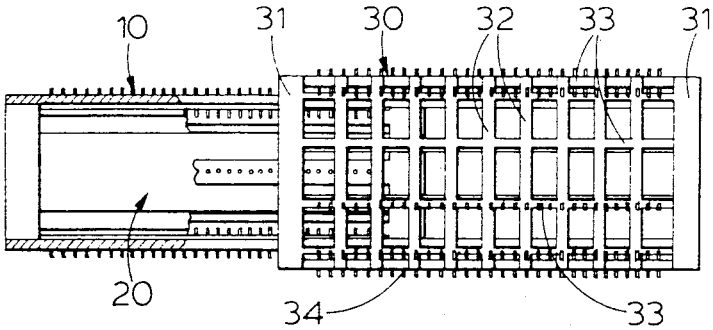

FIG. 1 is an exploded perspective view of a hair setting device according to the invention, FIG. 2 is a sectional view through the same device, FIG. 3 schematically illustrates a device for heating a central core of the device, and FIG. 4 is a view of a modified device.

DESCRIPTION OF SOME EMBODIMENTS

In the embodiment of the invention illustrated in FIGS. 1, 2 and 3 a hair setting or curling device comprises an outer generally cylinderical cage 10 conveniently made of resilient plastics material. The cage comprises two rings or end pieces 11 and a plurality of strips 12 which extend longitudinally between the rings 11. These strips are spaced from each other round the cage so that spaces 13 are left between adjacent strips. In use, hair to be curled is wrapped around the cage 10 and the strips 12 are therefore provided with bristle-like projections 14 which assist in gripping the hair.

An inner core or heater element 20 is fitted inside the outer case 10. This core consists of a generally tubular body 21 having an open end 35 to permit access to the central passage which enables the core to be fitted on an electrically heated post or pegs 22 of a multi-curler heating device schematically illustrated in FIG. 3. The core is made of a material which will retain heat imparted to it through the pegs or posts 22. The core is conveniently made of plastics material which will enable the core to be heated up to a temperature in the range of 50° C. to 120° C., typically 80° C. to 100° C. Alternatively, the tube may contain a fluid of high thermal capacity in the container (not illustrated). Flanges 23 are provided at opposite ends of the tubular body 21 and fit inside one or both rings 11 of the outer cage 10. Apertures 24 are provided in the flanges 23. These apertures allow an easier or more reliable fixing of a hair pin 25.

In use, the core is heated to a desired temperature by a heating device of the kind illustrated in FIG. 3. Other heating devices may be used if desired. The core is then removed from the heating device and applied to the hair which is wrapped around the cage to form the desired curling effect. A hair pin 25 which may be of conventional construction is inserted through the hair and the legs of the aperture extend through the spaces 13 between the strips 12 of the cage. As will be seen from the drawing, the hair pin will then be arranged with its legs substantially perpendicular to the axis of the roller and contact the tubular body of the core substantially tangentially. Hair is trapped by the hair pin and is lightly tensioned by the entry and re-exit of the legs through the apertures to hold the hair setting device in position. Warm air can circulate in the space between the core and the cage and around the hair and after a suitable time inverval the hair setting device can be removed to leave the hair in a waved condition.

FIG. 4 illustrates a modified device. In this modified device a core and outer cage 10 and 20 as hereinbefore described are removably fitted in a second cage 30. FIG. 4 shows the core and cage partially removed from the second cage 30. The second cage is also of lightweight plastics material and it comprises end rings 31 spaced between which is a plurality of intermediate rings 32. Longitudinally extending strips 33 extend between the end rings 31 and are connected with the intermediate rings 32. These longitudinal strips have bristle-like projections 34.

In use of this modified device hair is wrapped around the second cage and is held in position by the insertion of a hair pin as in the previous embodiment.

What is claimed is:

1. A hair setting roller having an outer cage comprising a plurality of longitudinally extending circumferentially spaced strips of material, and a heatable central core fabricated from a heat retaining material wholly received with said cage, said core having end flanges and a reduced diameter portion extending over a major portion of its length, said flanges being sized and positioned to fit within said cage to space said reduced diameter portion from said cage to define an air-circulating space therebetween to permit the circulation of air between said strips of material and through said space, whereby hairpins can be inserted through said space in a direction substantially perpendicular to the roller to maintain hair wound thereabout in place.

2. A roller as claimed in claim 1 in which said strips are provided with external projections to assist in retaining hair wrapped around the cage.

3. A roller as claimed in claim 1 or claim 2 wherein the central core is removable from the outer cage.

4. A roller as claimed in any of claims 1, 2 or 3, wherein a second cage removably surrounds and is spaced from the outer cage.

5. A roller as claimed in any of claims 1, 2, 3 or 4, wherein said core comprises a tubular body with flanges at each end, the flanges having apertures therein and engaging the interior of the outer cage.

6. A hair setting roller having an outer cage comprising a plurality of longitudinally extending circumferentially spaced strips of material and a heatable central core fabricated from a heat retaining material wholly received within said cage, said core having a portion of open-ended tubular form with flanges at opposite ends, said flanges having apertures therethrough and being arranged to fit inside said cage to space said tubular portion from said case and define an air circulating space therebetween to permit the circulation of air between said strips of material and through said space, whereby hairpins can be inserted through said space in a direction substantially perpendicular to the roller to maintain hair wound thereabout in place.

* * * * *